US011273533B2

(12) United States Patent
Boller

(10) Patent No.: US 11,273,533 B2
(45) Date of Patent: Mar. 15, 2022

(54) MACHINING MACHINE AND METHOD FOR OPERATING A MACHINING MACHINE

(71) Applicant: Lapmaster Wolters GmbH, Rendsburg (DE)

(72) Inventor: Hans-Peter Boller, Fockbeck (DE)

(73) Assignee: Lapmaster Wolters GmbH, Rendsburg (DE)

( * ) Notice: Subject to any disclaimer, the term of this patent is extended or adjusted under 35 U.S.C. 154(b) by 176 days.

(21) Appl. No.: 15/428,716

(22) Filed: Feb. 9, 2017

(65) Prior Publication Data

US 2017/0225292 A1 Aug. 10, 2017

(30) Foreign Application Priority Data

Feb. 9, 2016 (DE) ..... 102016102223.3

(51) Int. Cl.
*B24B 49/08* (2006.01)
*B24B 7/00* (2006.01)
*B24B 49/14* (2006.01)

(52) U.S. Cl.
CPC ..... *B24B 49/08* (2013.01); *B24B 7/00* (2013.01); *B24B 49/14* (2013.01)

(58) Field of Classification Search
CPC ..... B24B 37/08; B24B 37/28; B24B 37/042; B24B 7/17; B24B 7/228; B24B 55/02; H01L 21/02024
See application file for complete search history.

(56) References Cited

U.S. PATENT DOCUMENTS 4,665,658 A * 5/1987 Carcey ..... B24C 1/08 451/271
5,441,442 A * 8/1995 Haisma ..... B24B 37/08 451/288
2003/0186624 A1* 10/2003 Koike ..... G03F 1/60 451/8
2008/0038989 A1* 2/2008 Boller ..... B24B 7/17 451/5
2008/0233840 A1* 9/2008 Pietsch ..... B24B 37/08 451/41
2014/0273765 A1 9/2014 Chang et al.
(Continued)

FOREIGN PATENT DOCUMENTS

DE 102004040429 A1 2/2006
DE 102007013058 A1 9/2008
DE 102008056276 A1 5/2010
(Continued)

OTHER PUBLICATIONS

JP20170015455; Filed Jan. 31, 2017; Office Action dated Sep. 6, 2018; Lapmaster Wolters GmbH (7 pages).
(Continued)

*Primary Examiner* — Joel D Crandall
(74) *Attorney, Agent, or Firm* — Barclay Damon, LLP

(57) ABSTRACT

A machining machine includes an annular bottom working disk and a top counter bearing element. The bottom working disk and top counter bearing element are driven to rotate relative to each other. A working gap is defined between the bottom working disk and the top counter bearing to machine flat work pieces on at least one side. A means for generating a local deformation of the bottom working disk are also provided.

12 Claims, 3 Drawing Sheets

(56) References Cited

U.S. PATENT DOCUMENTS

2016/0031062 A1* 2/2016 Han ..... B24B 7/228
451/5

FOREIGN PATENT DOCUMENTS

| | | | |
|---|---|---|---|
| DE | 102006037490 | B4 | 4/2011 |
| DE | 102010024040 | A1 | 12/2011 |
| DE | 102013201663 | A1 | 6/2014 |
| JP | H08-90406 | | 4/1996 |
| JP | H09-193003 | | 7/1997 |
| JP | H10-058315 | | 3/1998 |
| JP | 2002-233-948 | | 8/2002 |
| JP | 2002-233948 | | 8/2002 |
| JP | 2004-314192 | | 11/2004 |
| JP | 2008-044098 | | 2/2008 |

OTHER PUBLICATIONS

CN20171070075;Filed Feb. 9, 2017; Office Action dated Sep. 6, 2018; Lapmaster Wolters GmbH (15 pages).
KR 20170018198; Filed Feb. 9, 2017; English Translation of Office Action dated Dec. 13, 2018; Lapmaster Wolters GmbH (13 pages).

* cited by examiner

MACHINING MACHINE AND METHOD FOR OPERATING A MACHINING MACHINE

CROSS REFERENCE TO RELATED APPLICATION

This application is based upon and claims priority to, under relevant sections of 35 U.S.C. § 119, German Patent Application No. 10 2016 102 223.3, filed Feb. 9, 2016, the entire contents of which are hereby incorporated by reference.

BACKGROUND

The invention relates to a double-side or one-side machining machine with a preferably annular bottom working disk and a top counter bearing element, wherein the bottom working disk and top counter bearing element can be driven to rotate relative to each other Between the bottom working disk and top counter bearing element is a working gap to machine flat workpieces on two sides or one side. The invention also relates to a method for operating such a double-side or one-side machining machine, and a method for setting up at least one bottom working disk in a double-side or one-sided machining machine.

For example, flat workpieces such as wafers are simultaneously machined on both sides in double-sided machining machines. For this purpose, double-sided machining machines have a top working disk and a bottom working disk between which a working gap is formed through which the work pieces to be machined are guided during processing. The top working disk is fastened to a top support disk, and the bottom working disk is fastened to the bottom support disk. For machining, a relative rotation between the working disks is produced by rotatably driving at least one of the working disks together with its support disk. Double-sided machining machines are known in which so-called rotor disks are guided. The rotor disks generally accommodate workpieces to be machined in circular openings in a floating manner. By suitable kinematics, it is ensured that the rotor disks also rotate within the working gap during the relative rotation of the working disks. As a result, the workpieces move along cycloid paths within the working gap. Particularly consistent surface machining is hereby achieved.

With machining machines of the kind at issue here, a change in the working gap arises between the working disks due to the process heat which arises during machining. In particular, a heat-related deformation of the working disks occurs and hence a deviation in the gap geometry from the stipulated shape. This negatively influences the result of machining. This applies in particular to the very high machining requirements of so-called prime wafers.

It is known from DE 10 2004 040 429 B4 to counteract negative effects from the arising process heat by controlling the temperature of the working disks. Channels are formed in the support disks or working disks through which corresponding temperature-controlling fluid such as cooling water is conducted. In practice, these temperature-controlling apparatuses cannot, however, always satisfy the maximum precision requirements in machining.

Furthermore, an apparatus for mechanically deforming the top support disk, and with it the top working disk attached thereto, is known from DE 10 2006 037 490 B4. With this apparatus, an initially flat working surface of the top working disk can be changed to a slightly concave surface. Conversely, an initially slightly convex working surface of the top working disk can be changed into a flat, or respectively concave working surface. With this global deformation of the top working disk as well, not all of the deviations from the ideal gap geometry that arise during operation from process heat can be compensated.

BRIEF SUMMARY OF THE INVENTION

Starting from the explained prior art, the object of the invention is to provide a double or one-side machining machine, as well as a method of operating said machining machine, by means of which an optimum machining result can be achieved despite the unavoidable process heat that arises during operation.

The disclosed double or one-side machining machine is configured to generate a local deformation of the bottom working disk.

For a method to operate such a double-side or one-side machining machine, the invention achieves the object in that the bottom working disk is deformed locally while processing workpieces such that it assumes a target geometry.

The machining machine can for example be a polishing machine, lapping machine, or a grinding machine. A working gap is formed between the bottom working disk and a counter bearing element such as a simple weight or pressure cylinder with one-sided machining machines, or a top working disk and a bottom working disc with double-side machining machines such that work pieces to be machined such as wafers are machined on both sides or one side. The machining machine can be double-side or a one-side. With a double-side machining machine, the bottom side and top side of workpieces can be preferably machined simultaneously in the working gap. Accordingly, both working disks can have a working surface that machines the workpiece surface. In contrast with a one-side machining machine, only one workpiece side is machined. In the present case, the bottom side is machined by the bottom working disk. In this case, only the bottom working disk has a working surface that machines the workpiece surface. The counter bearing element in this case only serves to form a corresponding counter bearing for machining by the bottom working disk.

The workpieces can be accommodated for machining to float in a known manner in openings in rotor disks arranged in the working gap. The bottom working disk and the counter bearing element are driven to rotate relative to each other during operation, for example by a top and/or bottom driveshaft and at least one drive motor. The top counter bearing element as well as the bottom working disk can be driven to rotate in the opposite direction relative to each other. It is, however, possible to only rotatably drive only one of the top counter bearing element and bottom working disk. For example, with a double-side machining machine, rotor disks can be moved by suitable kinematics to rotate during this relative rotation through the working gap so that workpieces arranged in the rotor disks describe cycloid paths in the working gap. For example, the rotor disks can have teeth on their outer edge and/or on their inner edge that engage in associated teeth, for example of the bottom working disk. Such machines with so-called planetary kinematics are well-known.

The bottom working disk may be annularly configured. The counter bearing element, or respectively the top working disk may also be annularly configured. The bottom working disk and the top counter bearing element such as the top working disk then possess facing annular working surfaces between which the annular working gap is formed. The working surfaces can be covered with a covering such as polishing cloths. Any support disks that hold the working disks may also be annularly configured, or at least possess annular support sections to which the working disks are fastened. More than one support disk per working disk can also be provided.

According to the invention, a means are provided by which the bottom working disk can be locally deformed, in particular between a local concave deformation and a local convex deformation. A local concave or convex deformation must be distinguished from a global concave or convex deformation as for example is known from DE 10 2006 037 490 B4. With a local deformation, the convex, or concave deformation or shape, lies in a radial direction between the inner and outer edge of the e.g. annular working disk. If the bottom working disk is not annular, the convex, or concave deformation or shape, lies in a radial direction between the center and the outer edge of the working disk. With the global deformation, the concave or convex shape, viewed in the radial direction, only arises over the entire diameter of the working disk. In a radial direction between the inner and outer edge of an annular working disk, or respectively between the center and the outer edge of a non-annular working disk, the working disk is contrastingly flat with an exclusively global deformation. The difference between a local deformation and global deformation of a working disk will be explained below with reference to FIGS. 4 to 6.

According to the invention, a smooth adjustment of the local shape of the bottom working disk between a maximum concave and a maximum convex shape determined by the installation, geometric, and material edge conditions is basically possible. The bottom working disk correspondingly possesses a sufficiently small thickness so that it can be deformed depending on its surface area, in particular its annular width, or respectively its turning radius. In the region of its greatest deformation, such as along an imaginary circle running in the middle on the annular working surface. The difference between the maximum concave shape and maximum convex shape of the bottom working disk can for example be about 200 μm.

By adjusting the bottom working disk in a radial direction, a change in the gap can be compensated more effectively by influencing the temperature while machining. During the machining process, many gap geometries are possible that yield optimum machining of the workpieces. The invention is particularly advantageous with large workpieces, such as large wafers that, for example, has a diameter of 450 mm or more. In this context, only one workpiece can be located in a rotor disk. In addition, the invention makes it possible to more effectively vary over wide ranges the process parameters such as rotary speed, specific load and amount of polish in polishing machines and thereby further optimize machining as the arising process heat can better be compensated. The erosion by machining per time can also be increased. The radial geometry of the annular width can be adapted by the deformation of the bottom working disk. If for example the radial geometry of the top counter bearing element, or respectively the top working disk, is slightly concave at the start of machining, the bottom working disk can be deformed in the convex direction in order to thereby restore an optimum parallel working gap geometry. If, during the subsequent machining process, the radial geometry of the top counter bearing element or respectively the top working disk changes in the convex direction due to the process heat, the bottom working disk can compensate for this by a corresponding deformation and thereby restore the optimum parallel working gap geometry.

According to the invention, a local deformation of the bottom working disk that is statically adjusted before machining is conceivable. It is also possible to provide a control apparatus for actuating the means for generating a local deformation of the bottom working disk. An operator can then, for example, save a desired local deformation in the control apparatus. It is also conceivable to specify certain working disk geometries for certain processing parameters of the machine that are then set by the control apparatus for machining.

According to one embodiment, the top counter bearing element can be formed by a preferably annular top working disk, wherein the working disks are arranged coaxially to each other and can be driven to rotate relative to each other, wherein the working gap is formed between the working disks to machine both sides or one side of flat workpieces. In particular, the machining machine can be a double-side machining machine.

The means for generating a local deformation of the bottom working disk can in principle be hydraulic means, and/or pneumatic means, and/or mechanical means.

According to an additional embodiment, the bottom working disk can be fastened to a bottom support disk, wherein the means for generating the local deformation in the bottom working disk can comprise an annular volume of pressure formed between the bottom support disk and the bottom working disk that is connected to a fluid supply which can be controlled so that pressure builds in the pressure volume which generates a predetermined local deformation of the bottom working disk. The fluid can be a liquid, in particular water. By introducing the fluid into the pressure volume, pressure can be exerted on the working disk, which is thin in comparison to the support disk, that leads to a deformation of the working disk. In particular, the working disk can be thereby changed to a locally concave shape by setting a low pressure in the pressure volume, to a locally flat shape by setting a medium pressure, and to a locally convex shape by setting a high pressure. The locally convex, or concave deformation or shape, lies between the inner and outer edge of the annular bottom working disk, in particular in the radial direction. The pressure volume is a changeable pressure volume. The bottom working disk forms a membrane that deforms depending on the volume of the pressure volume produced by the different pressure. The pressure that builds in the pressure volume to locally deform the bottom pressure disk can for example lie within a range of 0.4 to 1.5 bar.

The pressure fluid supply comprises a pressure fluid reservoir coupled to at least one pressure line that is connected to the pressure volume. A pump and a control valve can be arranged in the pressure line that can be actuated to build up the desired pressure within the pressure volume, for example by a control apparatus. In addition, the pressure fluid supply can comprise a pressure measuring apparatus that directly or indirectly measures the pressure in the pressure volume and can also send the measurements to the control apparatus. By suitably actuating the pressure fluid supply in the pressure volume, the required pressure for the desired working gap geometry can be adjusted on this basis. A highly parallel working gap, i.e., an unchanging distance between the working disks over the entire radial extent, is generally desirable.

According to another embodiment, provision can be made for the bottom working disk may be fastened only in the region of its outer edge and in the region of its inner edge to the bottom support disk. As previously discussed, the working disks can particularly be annular. The annular pressure volume is then formed between the bottom working disk and the bottom support disk. In the aforementioned embodiment, the bottom working disk is only fastened to the bottom support disk in the region of its radially outside and radially inside edge bordering the working disk, for example screwed along a divided circle. Between these edge regions, the working disk is contrastingly not fastened to the support disk. In particular, the annular pressure volume can be formed within this region. In this manner, the working disk possesses the required mobility in order to be deformed in the desired manner by building up a suitable pressure in the pressure volume. The attachment of the working disk to the support disk is selected so that the contact surface on the inner and outer edge is kept as narrow as possible in order to achieve a specific deformation over the entire surface of the working disk if possible.

According to another embodiment, a distance measuring apparatus can moreover be provided to determine the thickness of the working gap and/or working disk deformation. The distance measuring apparatus can comprise at least one distance measuring sensor that measures the working gap thickness and/or the working gap deformation at least one place in the working gap. For example, the at least one distance measuring sensor can measure the distance between the bottom working disk and a support disk holding the bottom working disk which acts in this case as a membrane. The distance measuring sensor is then preferably arranged on the radius of the maximum local deformation of the bottom working disk, in particular in the middle of the working disk. The distance measuring sensor can also measure the distance between the bottom working disk and the top counter bearing element, or respectively between the working disks, and for example be arranged in the top working disk.

The distance measuring apparatus can moreover comprise at least two distance sensors that measure the working gap thickness at least two radially spaced locations. For example, the distance measuring sensors can measure the distance between the bottom working disk and the counter bearing element, or respectively the distance between the working disks. The distance sensors can for example be arranged in the region of an edge of the working gap and in the middle of the working gap. According to another embodiment, the distance measuring apparatus can comprise at least three distance measuring sensors that measure the working gap thickness at at least three radially spaced points of the working gap to achieve improved measurement of the working gap geometry. In this case, the distance sensors can measure the distance at the inner and outer edge and in the middle of the working gap. It is possible for all distance measuring sensors to measure the distance between the bottom working disk and the top counter bearing element, or respectively between the working disks, and for example be arranged in the top working disk. A combination of the above-explained embodiments of the distance measuring apparatus is however also possible in which distance measuring sensors, for example on the inner and outer edge, measure the distance between the bottom working disk and the outer bearing element, or respectively the distance between the working disks, and in which a distance measuring sensor in the middle of the working disk measures the distance between the bottom working disk and a support disk that holds the bottom working disk.

According to another embodiment, a control apparatus can be provided that actuates means for generating a local deformation in the bottom working disk depending on the measurements received from the distance measuring apparatus so that a predetermined local deformation is created in the bottom working disk. In particular, the control apparatus can actuate the fluid supply in order to generate a pressure in the pressure volume that causes a predetermined local deformation of the bottom working disk. In this embodiment, the local deformation of the bottom working disk is controlled by a control apparatus at whose input the measurements are supplied from the distance measuring apparatus. If the control apparatus discerns a deviation in the working gap geometry from a predetermined geometry based on the values measured by the distance measuring device, it actuates the means for generating the local deformation such that the working gap resumes the predetermined geometry as closely as possible. This controlling according to the invention can in particular be automatic during production operation of the double or one-side machining machine.

Moreover, means can be provided for generating a global deformation of the top counter bearing element, in particular the top working disk. The control apparatus can be designed to also actuate the means for deforming the top counter bearing element. The actuation by the control apparatus can moreover be carried out depending on the measurements obtained from the distance measuring apparatus.

If at least three distance measuring sensors are provided that can measure the distance at least three radially spaced points in the working gap, the global adjustment of the working gap can be carried out by a global deformation of the top working disk through a reconciliation of the distance measuring sensors provided at the inner and outer edge of the working gap. The third, middle distance measuring sensor arranged between the inner and outer distance measuring sensors monitors the parallelism of the top and bottom working disk in a radial direction between the inner and outer edge of the working disk, i.e., the local parallelism. This local parallelism can also be optimally adjusted by suitable local deformation of the bottom working disk. The aim is generally to bring all of the distance values measured by the distance measuring sensors to the same value by suitably deforming the top working disk and/or the bottom working disk.

According to another embodiment, the top counter bearing element is a top working disk fastened to a top support disk, and the means for deforming the top working disk comprises a support ring on which the top support disk is suspended, wherein controllable means are arranged between the support ring and a ring section of the support disk disposed radially to the outside of the support ring by means of which a radial force is applied over the perimeter of the support ring to the support disk with the assistance of a force generator, wherein the control apparatus adjusts the force at the force generator depending on the distance values measured by the distance measuring apparatus, or by the pressure values measured by a measuring apparatus. The support ring can be rotatably connected to a top working shaft for rotatably driving the top support and working disk.

Moreover, a small-width annular channel running in a peripheral direction can be provided between the support ring and a ring section, and the force generator is a pressure generator that is connected to the annular channel and generates a predetermined pressure in the annular channel.

Moreover, a cylinder with a piston can be arranged on the support ring, the piston can interact with a cylindrical hole in the support ring and is connected via a transverse hole to the annular channel, and a hydraulic medium is accommodated in the annular channel and cylindrical hole. The piston can be actuated by a controllable pressure from a hydraulic source. In particular, the actuation can be hydropneumatic.

The aforementioned embodiments for globally deforming the top working disk are known in principle from DE 10 2006 037 490 B4 and can be used in a corresponding manner in the present invention.

According to another embodiment, temperature-controlling channels for conducting a temperature-controlling fluid can be formed at least in the bottom support disk, or in the bottom working disk, preferably also in the top support disk or in the top working disk. The temperature-controlling channels can be designed like a labyrinth or web. A temperature-controlling fluid, in particular a temperature-controlling liquid such as water can be guided through the temperature-controlling channels while the machine is operating to control the temperature, in particular to cool the working disk(s). To a certain extent, this can counteract a heat-related deformation of the working disks.

According to an embodiment with a particularly simple design, the temperature-controlling channels formed in the bottom working disk or the bottom support disk can be connected to the pressure volume. In this case, a suitable control valve is provided by means of which the pressure built up in the pressure volume can be controlled. In particular, a pressure can be thereby adjusted in the pressure volume that, for example, is smaller or the same as the pressure in the temperature-controlling channels. The control valve can in turn be actuated by the control apparatus.

The invention also achieves the object by means of a method for setting up at least one bottom working disk in a double or one-side machining machine according to the invention in which at least the working surface of the bottom working disk, preferably also the working surface of the top working disk, is set up in that at least the working surface of the bottom working disk, preferably also the working surface of the top working disk, is machined to remove material, preferably ground, wherein the bottom working disk is locally deformed while machining to remove material.

Given the unavoidable production and installation tolerances, working disks must be set up before they are operated for the first time, in particular in double-side machining machines. This is presently accomplished by an involved lapping process in which the working disks are machined to remove material over a long time until they possess the desired shape for subsequent operation. Because the bottom working disk is locally deformed in the aforementioned method according to the invention, for example brought into a locally convex shape, this setup procedure can be significantly shortened. In particular, it is possible to choose a grinding process instead of lapping. The working disks can thereby be brought into their desired shape for later operation significantly faster. In the method according to the invention, it is also possible to set up working disks for another machining machine in the machining machine used in the method.

BRIEF DESCRIPTION OF THE DRAWINGS

An exemplary embodiment of the invention is explained in greater detail below based on figures. In a highly schematic manner.

The same reference numbers refer to the same objects in the figures unless indicated otherwise.

DETAILED DESCRIPTION OF THE INVENTION

Figure 1:
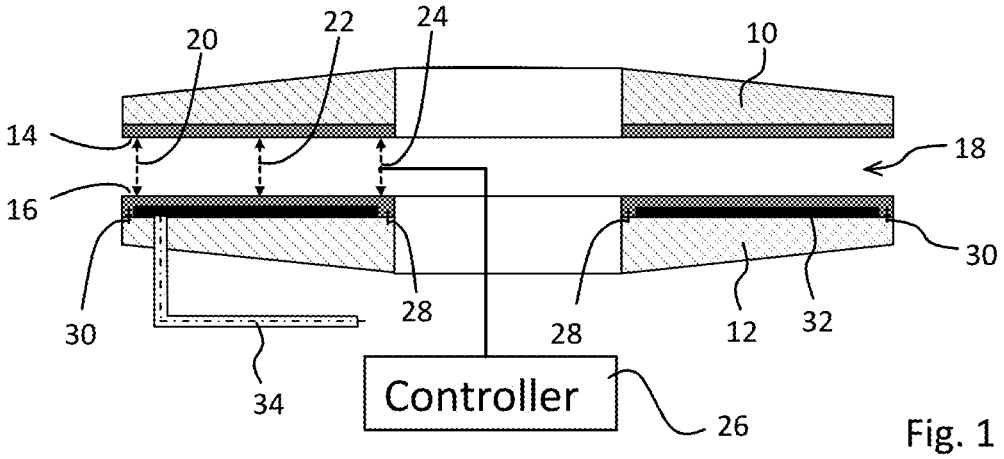
FIG. 1 illustrates a sectional view of a part of an embodiment of a double-side machining machine according in a first operating state.
Figure 2:
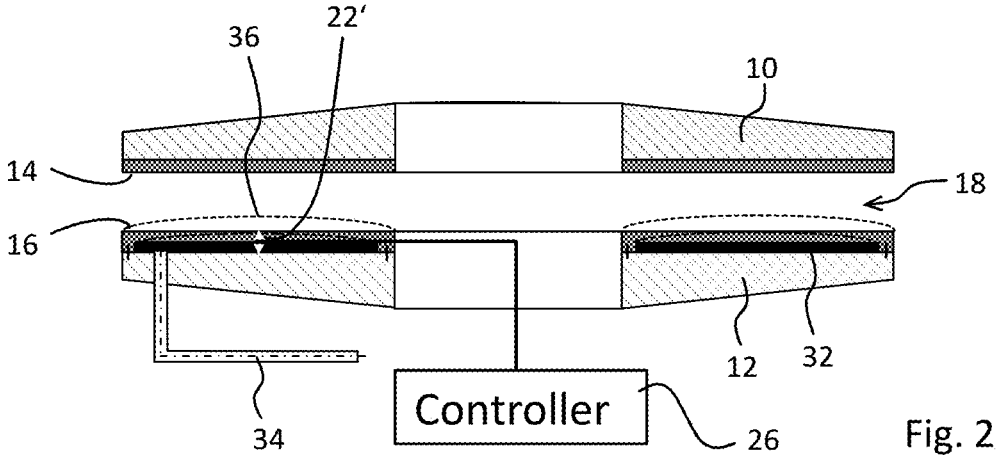
FIG. 2 illustrates a sectional view of the embodiment of FIG. 1 in a second operating state.
Figure 3:
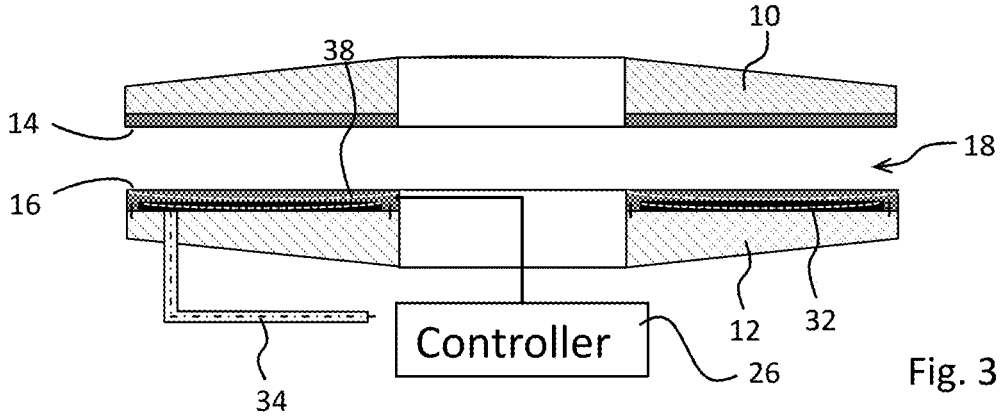
FIG. 3 illustrates a sectional view of the embodiment of FIG. 1 in a third operating state.

The double-side machining machine depicted merely as an example in FIGS. 1 to 3 has a top support disk 10 and a bottom support disk 12 that is annular. A top working disk 14 is fastened to the top support disk 10, and a bottom working disk 16 is fastened to the bottom support disk 12. Both the top working disk 14 and the bottom working disk 16 may be annular. Between the annular working disks 14, 16, a working gap 18 is formed in which flat workpieces such as wafers are machined on both sides during operation. The working gap 18 may be annular. The double-side machining machine can for example be a polishing machine, lapping machine, or a grinding machine.

The top support disk 10, with the top working disk 14, and/or the bottom support disk 12 with it the bottom working disk 16, can be rotatably driven relative to each other by a suitable drive apparatus comprising for example a top drive shaft (not shown), and/or a bottom drive shaft (not shown), as well as at least one drive motor (not shown). The drive apparatus is known per se and will not be described further for reasons of clarity. In a manner which is also known per se, the workpieces to be machined can be held to float in rotary disks in the working gap 18. By suitable kinematics, for example planetary kinematics, it can be ensured that the rotor disks also rotate through the working gap 18 during the relative rotation of the support disks 10, 12, or respectively working disks 14, 16. Temperature-controlling channels (not shown) can be formed in the top working disk 14, or the top support disk 10 and possibly also the bottom working disk 16 or the bottom support disk 12, through which a temperature-controlling fluid such as a temperature-controlling liquid like water can be conducted during operation. This is also known per se and not further described.

Figure 4:
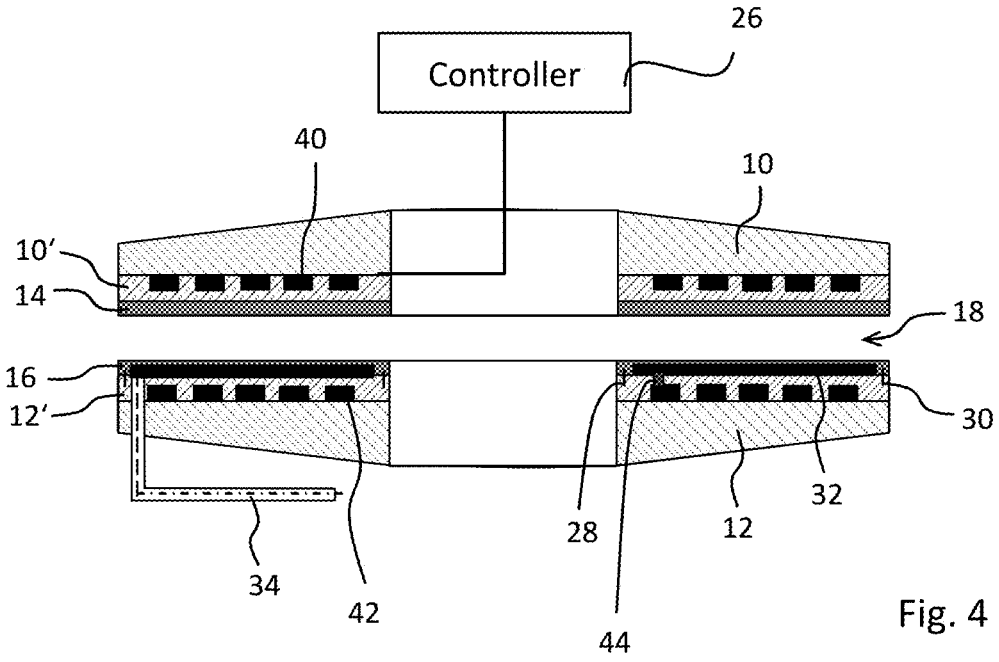
FIG. 4 illustrates a sectional view of a part of another embodiment of a double-side machining machine.

The double-side machining machine shown in FIGS. 1-3 additionally comprises a distance measuring apparatus that is also known per se and is not further described. It can for example function optically or electromagnetically (such as eddy current sensors). In the depicted example, the distance measuring apparatus may comprise three distance measuring sensors that measure the distance between the top working disk 14 and bottom working disk 16 at three radially spaced positions in the working gap. The arrangement of the distance measuring sensors is illustrated in FIG. 1 by the arrows 20, 22 and 24. As can be seen, the distance measuring sensor indicated with reference number 20 measures the distance between the top working disk 14 and the bottom working disk 16 in the region of the radially outer edge of the working gap 18. The measuring sensor indicated with reference number 24 measures the distance between the top working disk 14 and the bottom working disk 16 in the region of the radially inner edge of the working gap 18. The distance measuring sensor indicated with reference number 22 measures the distance between the top working disk 14 and the bottom working disk 16 in the middle of the working gap 18. As shown in FIG. 2, a distance measuring sensor is indicated with reference number 22' that measures the distance between the bottom working disk 16 and bottom support disk 12 in the middle of the working gap. This distance measuring sensor can be used alternatively to the distance measuring sensors shown in FIG. 1, or in combination with the distance measuring sensors shown in FIG. 1. For example, the distance measuring sensor 22' can replace the distance measuring sensor 22 shown in FIG. 1. The distance measuring sensors in FIGS. 3 and 4 are not shown for reasons of clarity. The measurements of the distance measuring sensors indicated with reference numbers 20, 22 and 24, or respectively 22' are applied to a control apparatus 26.

The bottom working disk 16 in the present case is only fastened in the region of its outer edge and the region of its inner edge to the bottom support disk 12, for example screwed along a divided circle in each case, as illustrated in FIG. 1 with reference numbers 28 and 30. Between these fastening sites 28 and 30, the bottom working disk 16 is contrastingly not fastened to the support disk 12. Instead, an annular pressure volume 32 is located between these fastening sites 28, 30 between the bottom support disk 12 and bottom working disk 16. The pressure volume 32 is connected by a dynamic pressure line 34 to a pressurized fluid reservoir such as a liquid reservoir, in particular a water reservoir (not shown in the figures). In the dynamic pressure line 34, a pump and a control valve can be arranged that can be actuated by the control apparatus 26. In this manner, fluid introduced into the pressure volume 32 can be built up within the pressure volume 32 to a desired pressure that then acts on the bottom working disk 16. The pressure predominating in the pressure volume 32 can be measured by means of a pressure measuring apparatus (not shown). The measurements from the pressure measuring apparatus can also be applied to the control apparatus 26 so that the control apparatus 26 can set a predetermined pressure within the pressure volume 32.

Due to its freedom of movement between the fastening sites 28, 30, the bottom working disk 16 can be brought locally into a convex shape by setting a sufficiently high pressure within the pressure volume 32 as indicated in FIG. 2 in a dashed line with reference number 36. If a pressure $p_0$ in the pressure volume 32 is assumed in the operating state in FIG. 1 in which the bottom working disk 16 has a flat shape, the convex deformation shown in FIG. 2 at 36 of the bottom working disk 16 can be achieved by setting a pressure of $p_1>p_0$. On the other hand, by setting a pressure of $p_2<p_0$ in the pressure volume 32, a local concave deformation of the bottom working disk 16 can be achieved as indicated by a dashed line in FIG. 3 with reference number 38.

Viewed in a radial direction, it can be seen that the bottom working disk 16 can assume a local convex shape (FIG. 2), or respectively a local concave shape (FIG. 3), between its inner edge in the region of the fastening site 28 and its outer edge in the region of fastening site 30.

A means can be provided for globally deforming the top working disk 14 in addition to this local radial deformation of the bottom working disk 16. These means can be designed as explained above, or respectively as described in DE 10 2006 037 490 B4. The top support disk 10 and with it the top working disk 14 fastened thereto are globally deformed so that a global concave or convex shape of the working surface of the top working disk 14 results over the entire cross-section of the top working disk 14. The top working disk 14 can contrastingly remain flat between its radially inner edge and its radially outer edge. The means for adjusting the shape of the top working disk 14 can also be actuated by the control apparatus 26.

While workpieces are being machined in the working gap 18, the distance measuring sensors 20, 22, 24, or respectively 22' measure the distance between the top working disk 14 and bottom working disk 16, or respectively between the bottom working disk 16 and bottom support disk 12. In an embodiment, the measurements are taken at regular intervals at their respective measuring site and communicated to the control apparatus 26. If the control apparatus 26 discerns a deviation from the specified working gap geometry, or respectively working disk deformation, in particular from an optimum parallelism between the working surfaces of the top and bottom working disks 14, 16, the control apparatus 26 controls the means for adjusting the shape of the top working disk 14, and/or the pressure fluid supply for the pressure volume 32 to deform the bottom working disk 16 in a suitable manner in order to achieve the desired optimum working gap geometry.

FIG. 4 shows a double-side machining machine according to another exemplary embodiment that is designed in principle like the double-side machining machine shown in FIGS. 1-3. The example shown in FIG. 4 differs from the example shown in FIGS. 1-3 only in that two top support disks, i.e., support disk 10 and support disk 10', as well as two bottom support disks, i.e., support disks 12 and 12' are provided in FIG. 4. The top working disk 14 is fastened to the top support disk 10' which in turn is held against the top support disk 10. The bottom working disk 16 is fastened to the bottom support disk 12' in the manner explained with reference to FIGS. 1-3, which in turn is held against the bottom support disk 12. Labyrinthine cooling lines are shown in the top support disk 10' in FIG. 4 at reference number 40. Labyrinthine cooling lines which are formed in the bottom support disk 12' are shown at reference number 42. During operation, a cooling liquid such as water is conducted through the cooling lines 40, 42. The bottom cooling lines 42 are moreover connected via a throttle hole 44 to the pressure volume 32. The pressure volume 32 and the bottom cooling lines 42 are supplied by the same pressure fluid supply in the depicted example, for example via a triple distributor. The triple distributor can supply the bottom cooling lines 42 that are kept at a set pressure by the control pressure control valve. The pressure volume 32 is also supplied through the throttle hole 44 with cooling liquid from the cooling lines 42. A third connection of the triple distributor is connected to the pressure volume 32, and the dynamic pressure in the pressure volume 32 can be controlled by a pressure control valve that is pilot-controlled by the control apparatus 26. The maximum dynamic pressure corresponds to the pressure in the cooling lines 42.

Figure 5:
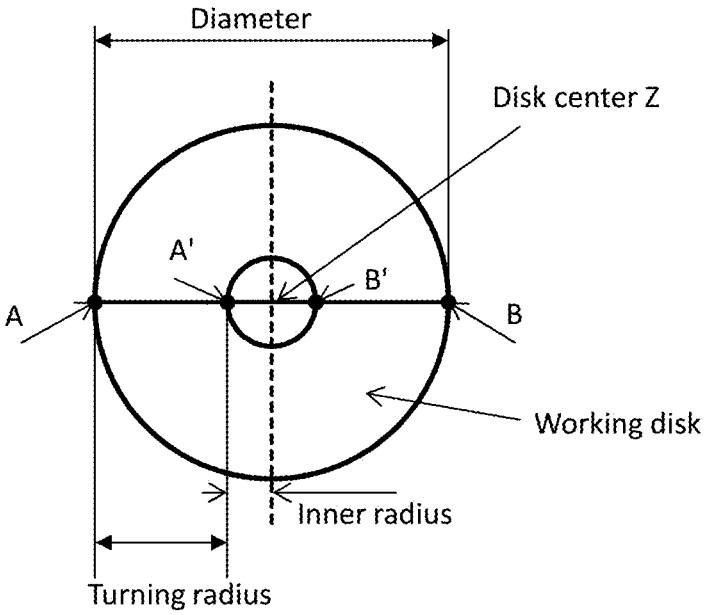
FIG. 5 illustrates a plan view of an embodiment of a working disk.

The difference between the local deformation of a working disk according to the invention and the global deformation of a working disk known from the prior art will be further explained with reference to FIGS. 5 to 7. FIG. 5 shows a plan view of an annular working disk as it can be used in the double or single-side machining machine according to the invention. The diameter of the working disk runs between the points A and B drawn in FIG. 5. The turning radius, or respectively the ring width of the annular working disk runs between points A and A', or respectively between points B and B'.

Figure 6:
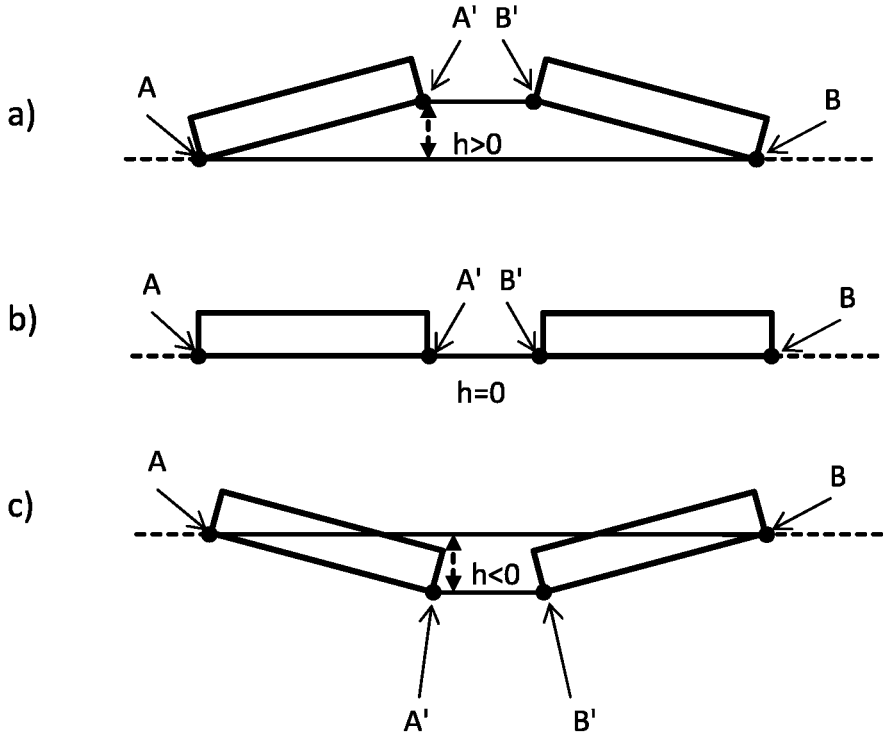
FIG. 6 illustrates a sectional view of a global deformation of the working disk of FIG. 5 along line A-B.

FIG. 6 shows a global concave deformation an embodiment of the top working disk in segment a). FIG. 6 shows a global convex deformation of the top working disk in segment c), and FIG. 6 shows the top working disk without a global deformation in segment b). With the exclusively global deformation depicted in FIG. 6, the distance between points A and A', or respectively the distance between points B and B' does not discernibly change in the different states of deformation, i.e., the working surface of the working disk is flat between the inner edge A' and the outer edge A, or respectively between the inner edge B' and the outer edge B. However, in the different states depicted in FIG. 6, the distance h in an axial direction of the working disk changes between the inner edge A', or respectively B' and the outer edge A, or respectively B, in FIG. 6, i.e., in a direction from top to bottom. Without a global deformation, this distance is h=0 (segment b)). Given a concave deformation, this distance is h>0 (segment a)), and given a convex deformation, this distance is h<0 (segment c)).

Figure 7:
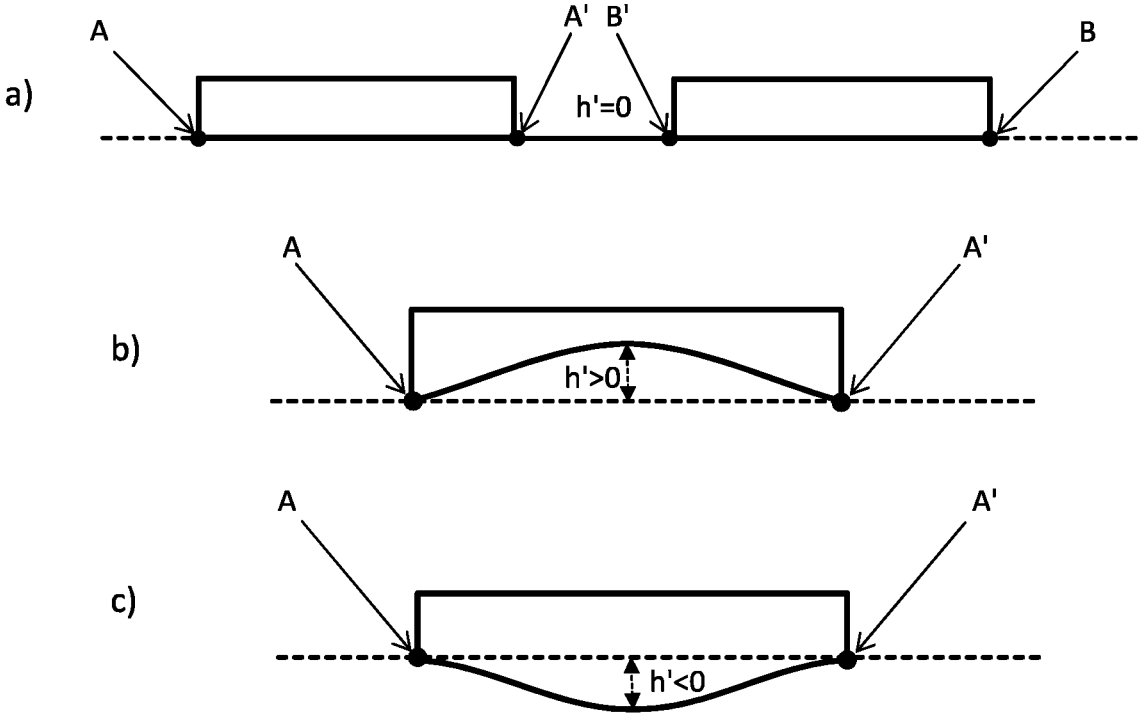
FIG. 7 illustrates a sectional view of a local deformation the working disk of FIG. 5 along line A-B, wherein only half of the cross-sectional view is depicted in segments b) and c) for the sake of visualization.

FIG. 7 shows an (exclusively) local deformation, also for a top working disk for reasons of clarity. As in segment b) in FIG. 6, a state without any deformation of the top working disk is shown in segment a) of FIG. 7. Segment b) of FIG. 7 shows a local concave deformation of the top working disk, and segment c) of FIG. 7 shows a local convex deformation of the top working disk. As can be seen in segments b) and c) in FIG. 7, the concave or respectively convex shape results in a radial direction between the inner edge A' and the outer edge A, or respectively between the inner edge B' and the outer edge B of the working disk, i.e., over the turning radius, or respectively the ring width. With a local deformation as shown in FIG. 7, the distance h' between any point on the working surface such as the middle of the working surface and the strait connecting line between the inner edge A' and the outer edge A (or respectively the inner edge B' in the outer edge B) of the working surface is not zero. In the event of a concave deformation as shown in segment b) in FIG. 7, h'>0. In the event of a convex deformation as shown in segment c) in FIG. 7, h'<0.

The invention claimed is:

1. A machining machine comprising:

a bottom working disk comprising an outer edge and an inner edge, a top counter bearing element, wherein the bottom working disk and top counter bearing element are configured to rotate relative to each other;

a working gap defined between the bottom working disk and the top counter bearing element, wherein the working gap comprises an inner and an outer edge and is configured to allow machining flat work pieces on at least one side; and a device configured to locally deform the bottom working disk during operation of the machining machine;

wherein the local deforming device includes a hydraulic supply;

a bottom support disk coupled to the bottom working disk, a plurality of labyrinthine cooling lines formed in the bottom support disk, an annular volume of pressure formed between the bottom support disk and the bottom working disk, the annular volume of pressure fluidly coupled to the plurality of labyrinthine cooling lines to supply a fluid to the annular volume in order to increase a pressure in the annular volume of pressure, wherein the increased pressure built in the annular volume of pressure is configured to produce a predetermined local deformation of the bottom working disk in a radial direction between the outer edge and the inner edge, wherein the local deformation is one of a concave shape and a convex shape; and a distance measuring apparatus comprising, three distance measuring sensors configured to measure a distance between the bottom working disk and the top counter bearing element, wherein a first distance measuring sensor of the three distance measuring sensors is positioned at the inner edge of the working gap, a second distance measuring sensor of the three distance measuring sensors is positioned at the outer edge of the working gap, and a third distance measuring sensor of the three distance measuring sensors is positioned between the first and second distance measuring sensors, and a control apparatus configured to receive signals from the three distance measuring sensors and generate a local deformation of the bottom working disk to compensate for geometry changes in the working gap during a machining operation, wherein the bottom working disk is only coupled to the bottom support disk in a region corresponding to the inner and outer edges of the bottom support disk, and wherein the annular volume of pressure is extended between the inner and outer edges of the bottom support disk.

2. The machining machine according to claim 1, wherein the control apparatus is configured to control the supply of the fluid to the annular volume of pressure.

3. The machining machine according to claim 1, wherein the top counter bearing element is a top working disk, and wherein the bottom working disk and the top working disk are arranged coaxially with respect to each other and are configured to rotate relative to each other, the top working disk and the bottom working disk define the working gap that is configured to machine at least one side of flat work pieces.

4. The machining machine according to claim 1, wherein the predetermined local deformation in the bottom working disk is produced by a device configured to be actuated by the control apparatus.

5. The machining machine according to claim 4, wherein the device configured to locally deform is also provided in the top counter bearing element.

6. The machining machine according to claim 5, wherein the control apparatus is configured to actuate the device configured to locally deform the top counter bearing element.

7. A method of operating a machining machine, the method comprising:

providing a bottom working disk defining an outer edge, an inner edge;

providing a top working disk; and rotating the bottom working disk and the top working disk relative to each other;

providing a working gap defined between the bottom working disk and the top working disk, the working gap configured to allow machining flat work pieces on at least one side; and wherein at least the bottom working disk is configured to locally deform the bottom working disk during operation of the machining machine;

wherein the step of locally deforming the bottom working disk includes the step of performing such local deformation by one of a hydraulic and a pneumatic means, which hydraulic and pneumatic means further comprises the steps of, coupling a bottom support disk to the bottom working disk wherein a plurality of cooling lines are formed in the bottom support disk in a web pattern, and, producing an annular volume of pressure between the bottom support disk and the bottom working disk, wherein the annular volume of pressure extends between an inner and an outer edge of the bottom support disk, coupling the annular volume of pressure to the plurality of cooling lines to supply a fluid to the annular volume of pressure, controlling the fluid supplied to the annular volume of pressure in order to control a pressure of the annular volume of pressure, coupling the bottom support disk in a region corresponding to the inner and outer edge of the bottom support disk, and automatically compensating for geometric changes in the working gap as the machining operation is performed, wherein a predetermined local deformation of the bottom working disk is produced in a radial direction between the outer edge and the inner edge in response to the pressure built up in the annular volume of pressure, and wherein the local deformation is one of a concave shape and a convex shape.

8. The method according to claim 7, wherein the bottom working disk is configured to deform locally while processing work pieces to assume a target geometry.

9. The method according to claim 7, wherein a distance between the bottom working disk and the top working disk is measured at one or more locations in the working gap, and wherein the local deformation is generated based on a measured distance at one or more locations.

10. The method according to claim 7, wherein the top working disk is configured to deform globally while processing work pieces so that the working gap assumes a target geometry.

11. A machining machine comprising:

a bottom working disk defining an outer edge and an inner edge;

a top counter bearing element, wherein the bottom working disk and top counter bearing element are configured to rotate relative to each other;

a working gap defined between the bottom working disk and the top counter bearing element, the working gap configured to allow machining flat work pieces on at least one side; and a device configured to locally deform the bottom working disk during operation of the machining machine;

wherein the local deforming device includes a hydraulic supply;

a bottom support disk defining an outside edge and a center, wherein the bottom support disk is coupled to the bottom working disk, a plurality of cooling lines formed in the bottom support disk and configured to carry a fluid; and an annular volume of pressure formed between the bottom support disk and the bottom working disk and extending between the outside edge and the center of the bottom support disk, wherein the annular volume of pressure configured to be coupled to at least one of the plurality of cooling lines to supply the fluid to the annular volume of pressure to control a pressure within the annular volume of pressure, wherein the bottom working disk is configured to undergo a predetermined local deformation of the bottom working disk in a radial direction between the outer edge and the inner edge of the working disk in response to a build-up of the pressure in the annular volume of pressure, and wherein the local deformation is one of a concave shape and a convex shape.

12. The machining machine of claim 11, wherein the bottom working disk is only coupled to the bottom support disk in a region corresponding to the inner edge and the center of the bottom support disk.

* * * * *